United States Patent [19]

Thosath

[11] Patent Number: 4,624,085

[45] Date of Patent: Nov. 25, 1986

[54] WINDOW STOP

[76] Inventor: James P. Thosath, 1919 E. 34th, Spokane, Wash. 99203

[21] Appl. No.: 739,160

[22] Filed: May 30, 1985

[51] Int. Cl.[4] ..... E06B 1/04

[52] U.S. Cl. ..... 52/204; 52/211

[58] Field of Search ..... 52/204, 211-213; 49/504

[56] References Cited

U.S. PATENT DOCUMENTS

| | | | |
|---|---|---|---|
| 713,132 | 11/1902 | Moore | 52/730 |
| 2,187,490 | 1/1940 | Dewey et al. | 52/212 |
| 2,635,720 | 4/1953 | Kolkey et al. | 52/211 |
| 2,651,393 | 9/1953 | Sylvan | 49/505 |
| 2,733,787 | 2/1956 | Morra . | |
| 2,851,742 | 9/1958 | Johnston | 52/211 |
| 2,863,534 | 12/1958 | Gillespie | 52/212 |
| 2,939,188 | 6/1960 | Wahlfeld | 52/211 X |
| 3,139,703 | 7/1964 | Hilt | 52/211 X |
| 3,583,114 | 6/1971 | Belfor | 52/217 |
| 3,975,875 | 8/1976 | Goss, Jr. | 52/211 |
| 4,228,630 | 10/1980 | Englert | 52/211 X |
| 4,328,644 | 5/1982 | Scott | 49/501 |
| 4,341,048 | 7/1982 | Minter | 52/211 |

FOREIGN PATENT DOCUMENTS

| | | | |
|---|---|---|---|
| 1115002 | 10/1961 | Fed. Rep. of Germany | 52/211 |

*Primary Examiner*—J. Karl Bell

*Attorney, Agent, or Firm*—Eugene M. Eckelman

[57] ABSTRACT

A pair of jamb legs and a head piece of identical structure are arranged to be cut to fit in a roughed-in frame for a window. Each of the jamb legs and head piece has a first flange leading outwardly at a right angle at a point rearwardly of its front edge and arranged to butt against the front surface of the roughed-in window frame for securement to the frame by fasteners. Also, each of the jamb legs and head piece has a second right angle flange leading outwardly at a right angle at a point forwardly of the rear edge and in a direction opposite from the first flange. A sill piece is used in combination with the jamb legs and head piece for completing a window frame, and this sill piece has a first flange leading downwardly at a right angle at a point rearwardly of its front edge and arranged to abut against the front surface of the roughed-in frame. The sill piece has an inclined top wall angled downwardly toward the front and also has a vertical edge forward of its rear edge. The portion of the jamb legs, head piece, and sill piece which is forward of their flanges providing abutment for siding or molding to be installed around the stop. The rear of the second flanges of the jamb legs and the head piece and the vertical rear edge of the sill piece are in substantial lateral alignment and comprise an abutting securing surface for a pane of glass.

4 Claims, 4 Drawing Figures

WINDOW STOP

BACKGROUND OF THE INVENTION

This invention relates to a new and novel window stop.

There is a need in the building industry for a stop for fixed windows that provides a quality construction and yet one that is not overly complex in structure, expensive to manufacture, and difficult to install. Such a stop is needed that readily fits in a roughed-in opening without special tools and one that provides a means of mounting a pane of glass from the inside of the building. Various devices such as covered in U.S. Pat. Nos. 2,733,787, 3,583,114, and 4,328,644, are representative of window framing or the like, and although the structures thereof may employ extruded parts, they do not achieve the combined features of simplicity, low cost, ease of installation, and a capability of mounting a simple pane of glass from the inside.

SUMMARY OF THE INVENTION

A primary objective of the invention is to provide a window stop which contributes to a quality construction but at the same time is simplified and inexpensive as well as easy to install.

A more particular object of the present invention is to provide a window stop of the type described which employs two only extrusions, one extrusion being cut to form opposite sides and the top of the stop and the other extrusion being cut to form the sill.

Another object of the invention is to provide a window stop of the type described that can be supplied in elongated lengths of extrusions and which can be readily cut to dimension.

In carrying out the objectives of the invention, the stop comprises a pair of jamb legs arranged to fit against the side surfaces of a roughed in frame. The stop also includes a separate head piece arranged to fit against the top surface of the roughed in frame. Each of these members comprises a flat body member arranged to lie flat against their respective surfaces and each has a first flange leading outwardly at a right angle at a point rearwardly of their front edges for abutment against the front surface of the roughed in frame for securement to the frame by fasteners and also each has a second right angle flange leading outwardly at a right angle at a point forwardly of the rear edge and in a direction opposite from the first flange to which a pane of glass is secured. The stop also includes a sill piece which seats on the bottom surface of the roughed in frame, and this sill piece has a first flange leading downwardly from its bottom wall which abuts against the front surface of the roughed-in frame and it also has inclined walls angled downwardly toward the front. The sill piece has a rear vertical edge aligned approximately with the second flanges of the jamb legs and head piece against which the glass is secured. The portions of the jamb legs, head piece and sill piece which are forward of their respective first flanges provide abutment for siding or molding to be installed around the stop. The sill piece is hollow and has an upright front wall connecting the bottom wall and top wall. Upon selected cutting of the four pieces, the stop can be readily installed in the roughed in frame and sealed in with caulking in a weather tight installation.

The invention will be better understood and additional objects and advantages will become apparent from the following description taken in connection with the accompanying drawings.

DETAILED DESCRIPTION OF PREFERRED EMBODIMENTS

Figure 1:
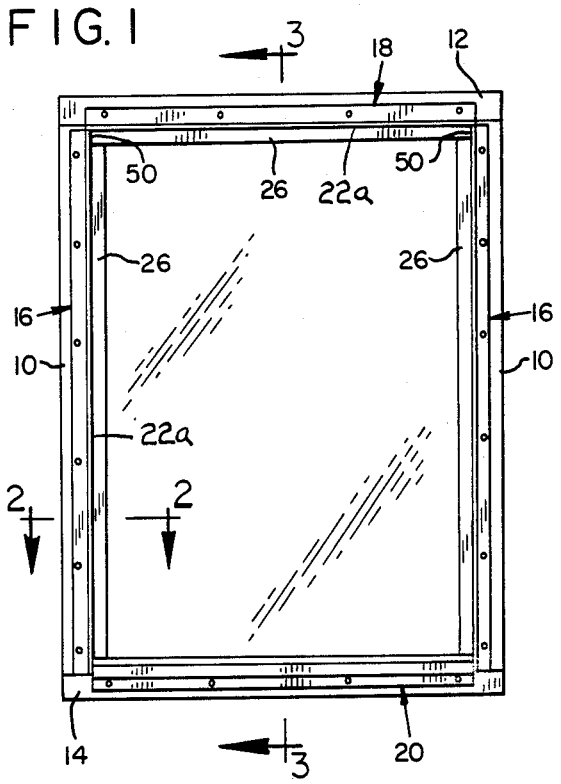
FIG. 1 is a front elevational view of the present window stop installed in a roughed in frame.
Figure 2:
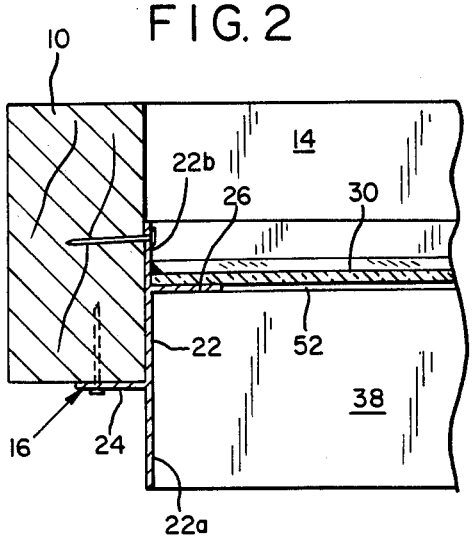
FIGS. 2 and 3 are enlarged sectional views taken on the lines 2—2 and 3—3 of FIG. 1 respectively.
Figure 3:
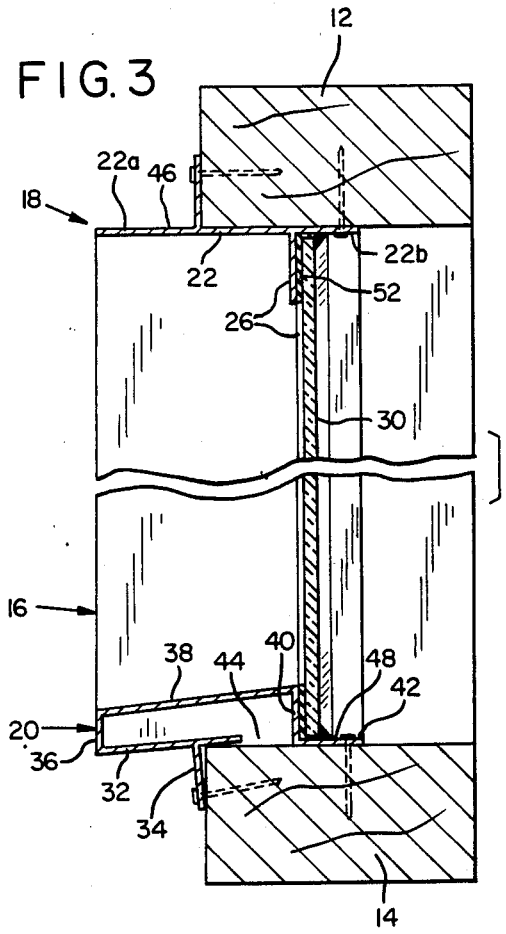

With particular reference to the drawings and first to FIGS. 1, 2 and 3, the invention is designed for use with a window opening comprising a roughed in frame having side frame members 10, a top frame member 12, and a bottom frame member 14. As will be more apparent hereinafter, the present stop can be readily custom cut to fit various framed in openings. It has four parts, comprising a pair of jamb legs 16, a head piece 18, and a sill piece 20. Jamb legs 16 and head piece 18 are of identical structure and can be formed in continuous length by extrusion and cut to length for installation. Sill piece 20 comprises another extrusion and is cut to length for installation. The entire stop merely comprises these two extrusions.

With particular reference to FIGS. 2 and 3, the members 16 and 18, namely, the first extrusion, comprise a longitudinal plate-like body member 22 arranged to lie flat against the inner surface of its respective window frame member. An integral flange 24 projects at right angles from the body member at a point about an inch or little less rearwardly of the front edge to form a projecting portion **22*a* extending beyond the frame member. A second right angle flange 26 projects in the opposite direction from the flange 24 and is disposed an inch or so forwardly of the rear edge, forming a rear extension or flange 22*b*. Flange 24 and extension 22*b* form nailing portions for securing these pieces securely in place. Flange 26 forms a fin against which a pane of glass 30** is secured, as will be more apparent hereinafter.

Sill piece 20 comprises a body member 32 arranged to seat on the upper surface of the frame member 14 and such body member has a depending flange 34 which is arranged to be secured to the front surface of the frame member 14.

Sill piece 20 has an upright front wall portion 36 from which a sill surface 38 angles upwardly toward the inside of the building to provide run-off of any moisture. Body member 32 also angles downwardly to avoid migration of moisture on its bottom surface. A vertical wall 40 extends downwardly from the inner end of the surface 38 and leads into a horizontal flange 42. The rearward end of body member 32 and the rear wall 40 are separated by a gap 44 for the purpose of utilizing minimum material in the sill piece. As will be more apparent hereinafter, the vertical rear wall 40 of the sill piece comprises an abutment for the pane 30.

The portions 16, 18 and 20 of the present window stop shown in FIGS. 1–3 are all cut at 90 degrees and such cutting can readily be accomplished on a chop saw. A preferred manner of installation is to first cut the jamb legs 16 one sixteenth inch shorter than the rough opening. The head piece is cut the full width of the opening and slides over these shortened jamb legs from the outside. The top edge of the jamb legs, as cut to the slightly shorter length, is designated by the numeral 46 in FIG. 3. Prior to installing the jamb legs, the bottom edge of the flanges 26 and rear extension **22*b* are relieved one eighth inch to allow the sill to slide in from the outside, such relieved bottom edges being designated by the numeral 48 in FIG. 3. The head piece 18 is then cut long enough to fit over the jamb legs but first its flange 26 is relieved one sixteenth inch at each each end to clear the thickness of the jamb legs, these relieved edges being designated by the numerals 50 in FIG. 1. The sill piece 20 is then cut to proper length to slide in between the jamb legs from the outside. Proper securement of these parts to the frame is then accomplished by flanges 22*b*, 24, 34 and 42**.

All the corners between the members 16, 18 and 20 are caulked to assure a weather tight installation. The glass pane is installed from the inside of the building against the flanges 26 of the jamb legs and the head piece and against the rear wall 40 of the sill piece. The glass is installed by glazing 52 on the flanges and wall 40 and wherever necessary to insure a weather tight enclosure.

Figure 4:
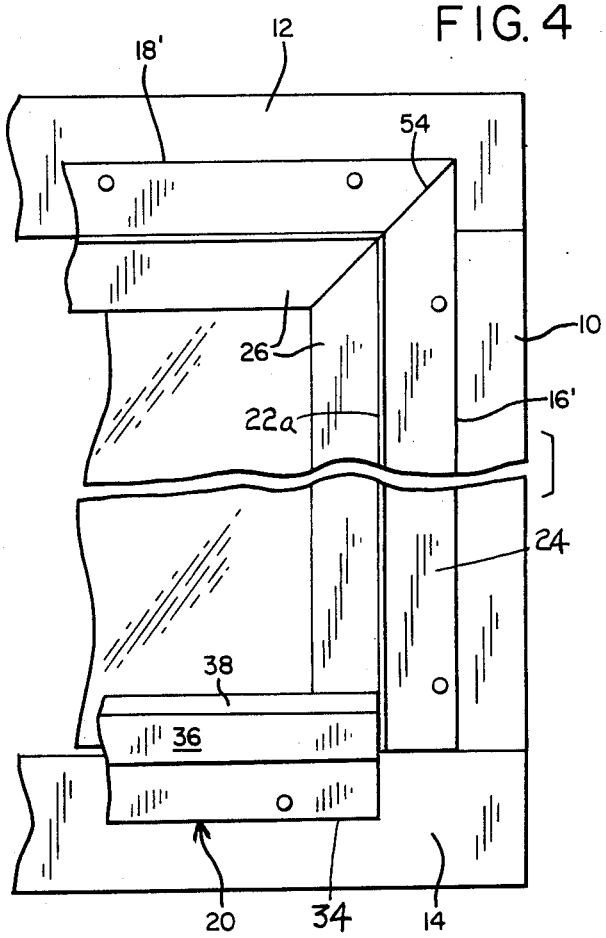
FIG. 4 is an enlarged fragmentary and foreshortened front elevational view of a slight variation in structure.

FIG. 4 shows a modified form of the invention. The structure thereof is similar to the embodiment of FIGS. 1, 2 and 3 except that the upper corners 52 between the jamb legs 16' and head piece 18' are mitered. This form of the invention has the advantage that these corners have tighter fits than the type of corners shown in FIG. 1 and some of the relieving to accomplish the fits are not necessary. However, the embodiment of FIG. 1 has the important advantage that all cuts can be made at 90 degrees and this greatly simplifies installation. The projecting portions **22*a* and 32** provide abutment for sheathing or siding, or molding, as desired or necessary in the construction of the building.

It is to be understood that the forms of my invention herein shown and described are to be taken as preferred examples of the same and that various other changes in the shape, size and arrangement of parts may be resorted to without departing from the spirit of my invention or the scope of the subjoined claims.

Having thus described my invention, I claim:

1. A window stop for fixed windows of the type having a roughed-in frame with side, top, bottom and front surfaces, said stop comprising a pair of jamb legs having front and rear edges and arranged to fit against the side surfaces of a roughed-in frame, a head piece having front and rear edges and arranged to fit against the top surface of the roughed-in frame, each of said jamb legs and head piece comprising a flat body member arranged to lie against the respective surfaces, each of said jamb legs and head piece also having a first flange leading outwardly from said body member at a right angle at a point rearwardly of said front edge and arranged to abut against the front surface of the roughed-in frame for securement to the frame by fasteners, each of said jamb legs and head piece also having a second right angle flange leading outwardly from said body member at a point forwardly of said rear edge and in a direction opposite from said first flange, and a sill piece comprising a body member having front and rear portions and arranged to seat against the bottom surface of the roughed-in frame, said sill piece body member having a first flange leading downwardly therefrom at a right angle and at a point rearwardly of its front portion and arranged to abut against the front surface of the roughed-in frame, said sill piece body member having a first vertical wall at its front portion and a second vertical wall forward of its rear portion, said sill piece body member also having a top wall angled downwardly between said first and second vertical walls, said rear portion of said sill piece body member comprising a horizontal flange, said first flange and horizontal flange at said rear portion being arranged to be secured to the roughed-in frame by fasteners, the portion of said jamb legs, head piece, and sill piece which is forward of their respective first flanges being arranged to provide abutment for siding or molding to be installed around the stop, the rear of said second flanges of the jamb legs and the head piece and said vertical rear wall of said sill piece being in substantial lateral alignment and being arranged to comprise an abutting securing surface for a pane of glass.

2. The pane stop of claim 1 wherein said sill piece body member comprises a hollow extruded member cut to a length and includes a bottom wall integrated with said top wall in spaced relation by said upright front wall, said bottom wall terminating short at the rear thereof from said second vertical wall to form a gap therebetween.

3. A window structure comprising a roughed-in frame with side, top, bottom and front surfaces, a pane stop including a pair of jamb legs having front and rear edges and fitting against the side surfaces of said roughed-in frame, a head piece having front and rear edges and fitting against the top surface of said roughed-in frame, each of said jamb legs and head piece comprising a flat body member which lies in fitted engagement against the respective frame surfaces, each of said jamb legs and head piece having a first flange leading outwardly from said body member at a right angle at a point rearwardly of said front edge for abutment against the front surface of said roughed-in frame for securement to the frame by fasteners, each of said jamb legs and head piece also having a second right angle flange leading outwardly from said body member at a point forwardly of said rear edge and in a direction opposite from said first flange, and a sill piece comprising a body member having front and rear portions and seating against the bottom surface of said roughed-in frame, said sill piece body member having a first flange leading downwardly therefrom at a right angle and at a point rearwardly of its front portion and abutting against the front surface of said roughed-in frame, said sill piece body member having a first vertical wall at its front portion and a second vertical wall forward of its rear portion, said sill piece body member also having a top wall angled downwardly between said first and second vertical walls, said rear portion of said sill piece body member comprising a horizontal flange, said first flange in said horizontal flange at said rear portion of said sill piece being secured to said roughed-in frame by fasteners, the portion of said jamb legs, head piece and sill piece which is forward of their respective first flanges being arranged to provide an abutment for exterior siding or molding to be installed around the stop, the rear of said second flanges of the jamb legs and the head piece and said vertical rear wall of said sill piece being in substantial lateral alignment and comprising an abutting securing surface for a pane of glass.

The window structure of claim 3 wherein said jamb legs are cut to a lesser height than said roughed in frame to allow said head piece to slide in from the front, and said second flanges of said jamb legs being relieved at the bottom to allow said sill to slide in from the front.

* * * * *